US006651576B1

(12) United States Patent
Lo

(10) Patent No.: US 6,651,576 B1
(45) Date of Patent: Nov. 25, 2003

(54) HIDDEN CLEAT FOR BOAT

(75) Inventor: Nico Lo, Hsinchu (TW)

(73) Assignee: Hsiang Tzer Enterprise Co., Ltd., Hsinchu (TW)

( * ) Notice: Subject to any disclaimer, the term of this patent is extended or adjusted under 35 U.S.C. 154(b) by 0 days.

(21) Appl. No.: 10/215,009

(22) Filed: Aug. 9, 2002

(51) Int. Cl.[7] ..... B63B 21/04
(52) U.S. Cl. ..... 114/218; 410/107
(58) Field of Search ..... 114/218; 410/101, 410/107, 111

(56) References Cited

U.S. PATENT DOCUMENTS 4,945,849 A * 8/1990 Morris et al. ..... 114/218
5,106,248 A * 4/1992 Harris ..... 410/107
5,535,694 A * 7/1996 Czipri ..... 114/218
5,983,820 A * 11/1999 Whitley ..... 114/218
6,125,779 A * 10/2000 Czipri ..... 114/218
6,464,437 B1 * 10/2002 Elwell ..... 410/107

* cited by examiner

*Primary Examiner*—S. Joseph Morano
*Assistant Examiner*—Andrew Wright
(74) *Attorney, Agent, or Firm*—Rosenberg, Klein & Lee

(57) ABSTRACT

A hidden cleat structure for boat comprises a seat body, a mobile pile, elastic components, a driving piece, and a driving rod. The mobile pile longitudinally and slidably connects the seat body. The elastic components are disposed in the sliding direction between the mobile pile and the seat body. The driving piece can move transversely, and is disposed in a receiving cavity of the seat body. An erect heart-shape track is disposed on the driving piece. One end of the driving rod is fixed on the mobile pile, and the other end thereof is located in the heart-shaped track. The heart-shape track includes an upper and a lower stop points and two transitional points obliquely placed in the clockwise or counterclockwise direction. The driving rod can make uni-directional circulatory motion in the heart-shaped track along with upward and downward slide of the mobile pile.

8 Claims, 8 Drawing Sheets

HIDDEN CLEAT FOR BOAT

FIELD OF THE INVENTION

The present invention relates to a modified cleat structure for a boat and, more particularly, to a movable hidden cleat structure for a boat, which does not occupy usable space when not in use.

BACKGROUND OF THE INVENTION

Cleats are usually distributed at the periphery in a boat, and are fixed on a deck of a boat body. They are used to fix cargos on the boat or are used to tie cables when the boat is berthed at a dock.

As shown in FIG. 1, a conventional cleat structure for boat comprises a transverse rod 10 and two vertical rods 12 connected below the transverse rod 10. The transverse rod 10 is fixedly locked onto a boat deck 16 with two screw bolts 14 through the two vertical rods 12, and is tied by a cable. When cleats are used to fix cargos, the cable is wound around the cargos, and two ends of the cable are fixed at the two vertical rods of different cleats, thereby fixing the cargos and preventing the cargos from easily loosening or moving. When the boat is berthed at a dock, one end of the cable is wound around the vertical rods of a cleat and tightly tied up, while the other end of the cable is fixed at the dock, thereby firmly tying the boat to prevent it from drifting away from the dock.

However, because existent cleats for boat are projective from and fixed on the boat deck, they not only occupy the space of the boat deck, but also may easily stumble careless people passing by to cause hazards. Besides, because conventional cleats are fixed projective objects on the deck, there is much limit to their installation positions. They can only be installed on the deck at the edge of the boat body to avoid passageways or activities places.

Accordingly, the present invention aims to propose a hidden cleat structure for boat to effectively resolve the problems in the prior art.

SUMMARY OF THE INVENTION

The primary object of the present invention is to provide a hidden cleat for boat of convenient use, which can be conveniently unfolded when in use and can be conveniently hidden when not in use, hence having the advantage of not occupying space of the boat deck when not in use.

Another object of the present invention is to provide a hidden cleat for boat, which can effectively prevent people passing by from stumbling to provide a hidden cleat structure of high safety.

Another object of the present invention is to provide a hidden cleat for boat, which can be installed at any convenient place because of its mobile hidden structure.

To achieve the above objects, a hidden cleat structure for boat of the present invention comprises a seat body, a mobile pile, elastic components, a driving piece, and a driving rod. The mobile pile longitudinally connects the seat body, and can slide up and down on the seat body. The elastic components are disposed in the sliding direction between the mobile pile and the seat body. The driving piece can move transversely, and is disposed in a receiving cavity of the seat body. An erect heart-shape track is disposed on the driving piece. The heart-shape track includes an upper and a lower stop points and two transitional points, which are obliquely placed in the clockwise or counterclockwise direction, hence forming a unidirectional circulatory closed track. One end of the driving rod is fixed on the mobile pile. and the other end thereof is located in the heart-shaped track of the driving piece.

The various objects and advantages of the present invention will be more readily understood from the following detailed description when read in conjunction with the appended drawings, in which:

DETAILED DESCRIPTION OF THE PREFERRED EMBODIMENTS

The present invention designs a mobile hidden cleat for boat, which can be conveniently unfolded when in use and can be conveniently hidden when not in use, hence having the advantage of not occupying space of the boat deck.

Figure 1:
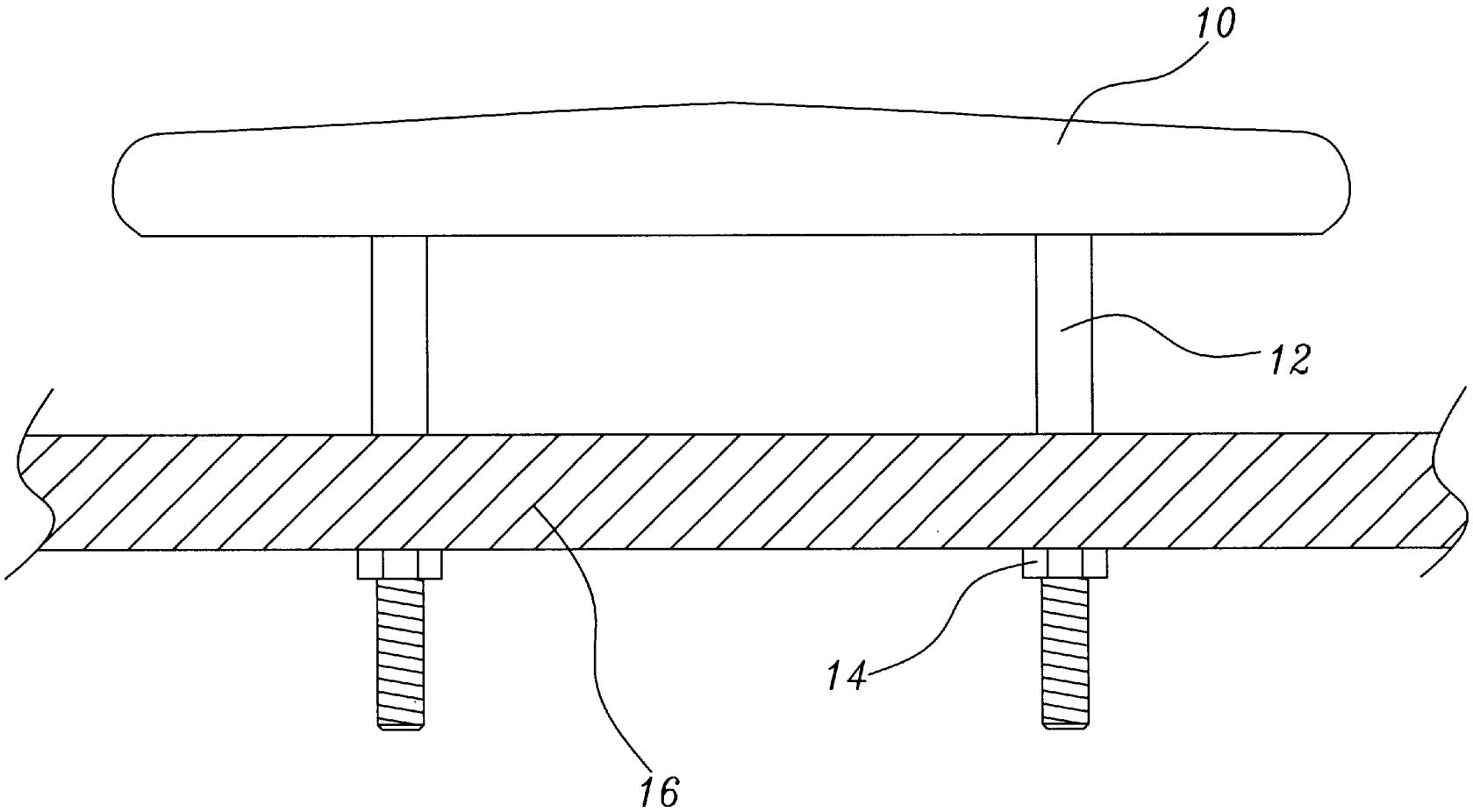
FIG. 1 is a structure diagram of a conventional cleat.
Figure 2:
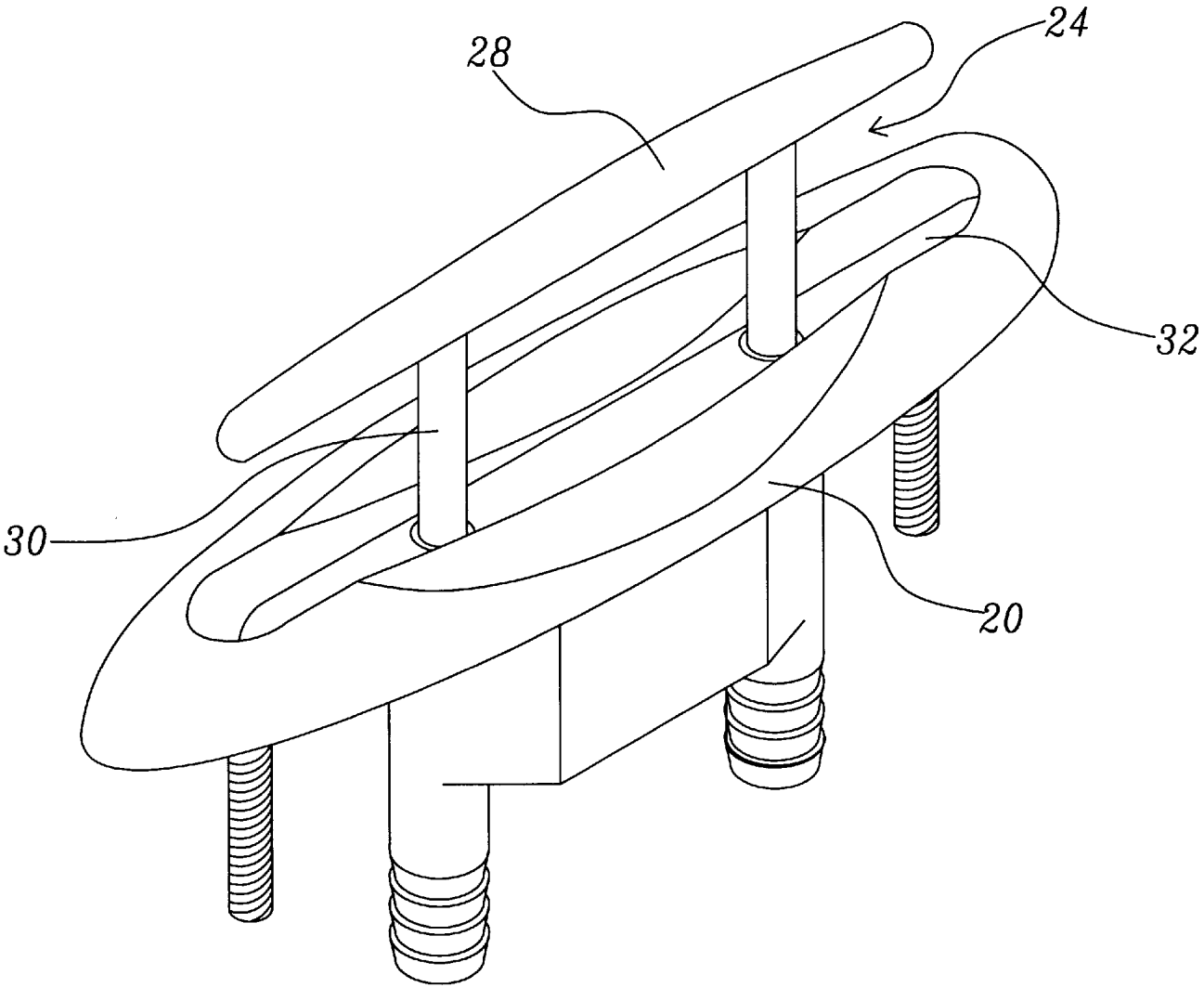
FIG. 2 is a perspective structure diagram of the present invention.
Figure 3:
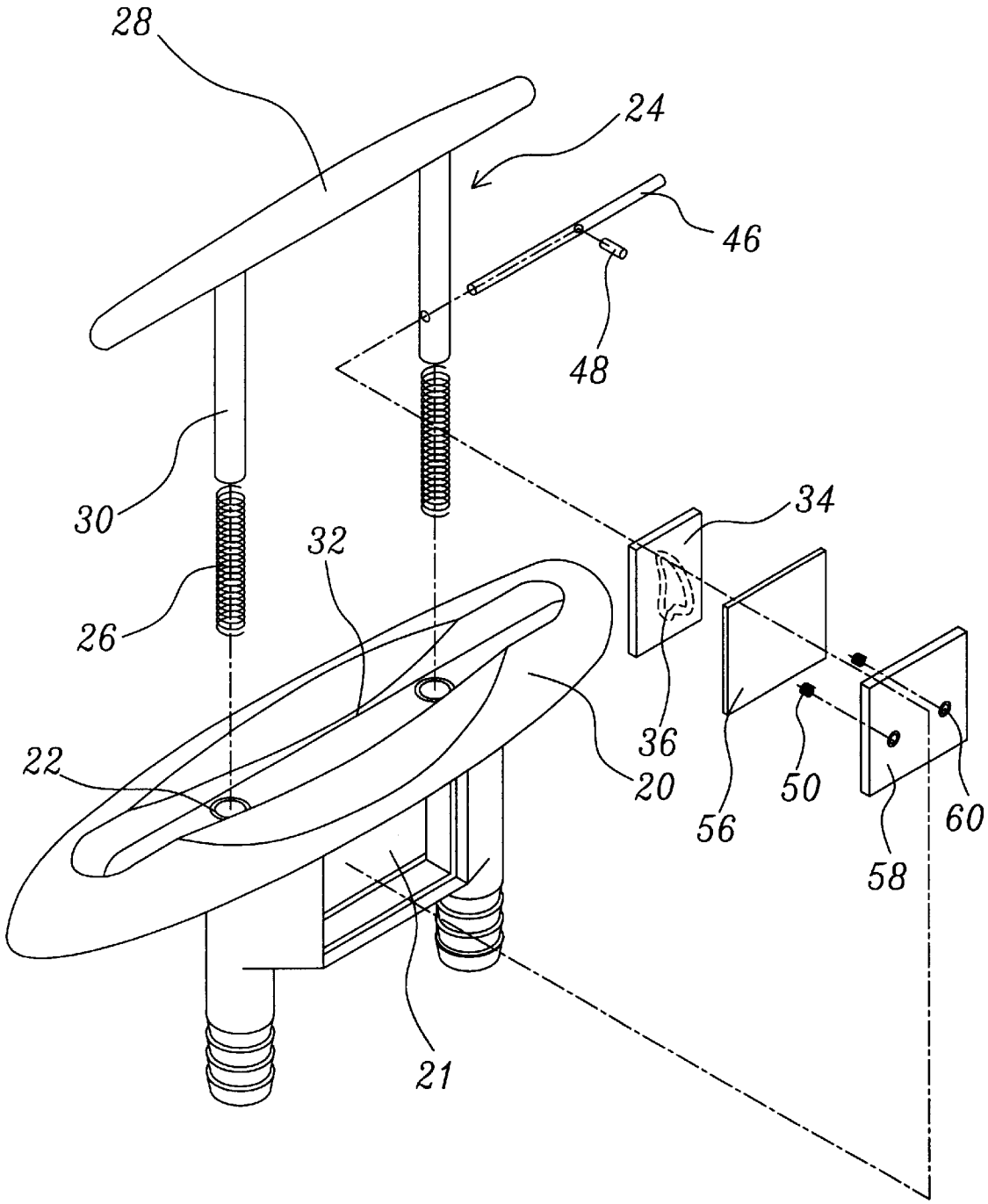
FIG. 3 is an exploded perspective structure diagram of the present invention.

As shown in FIGS. 2 and 3, a hidden cleat for a boat comprises a seat body 20 having a receiving cavity 21 therein. Two longitudinal vertical holes 22 are disposed in the seat body 20 at two sides of the receiving cavity 21. A mobile pile 24 longitudinally connects to the seat body 20, and can slide up and down on the seat body 20. Two elastic components, preferably springs 26, are disposed in the sliding direction between the mobile pile 24 and the seat body 20.

Figure 4:
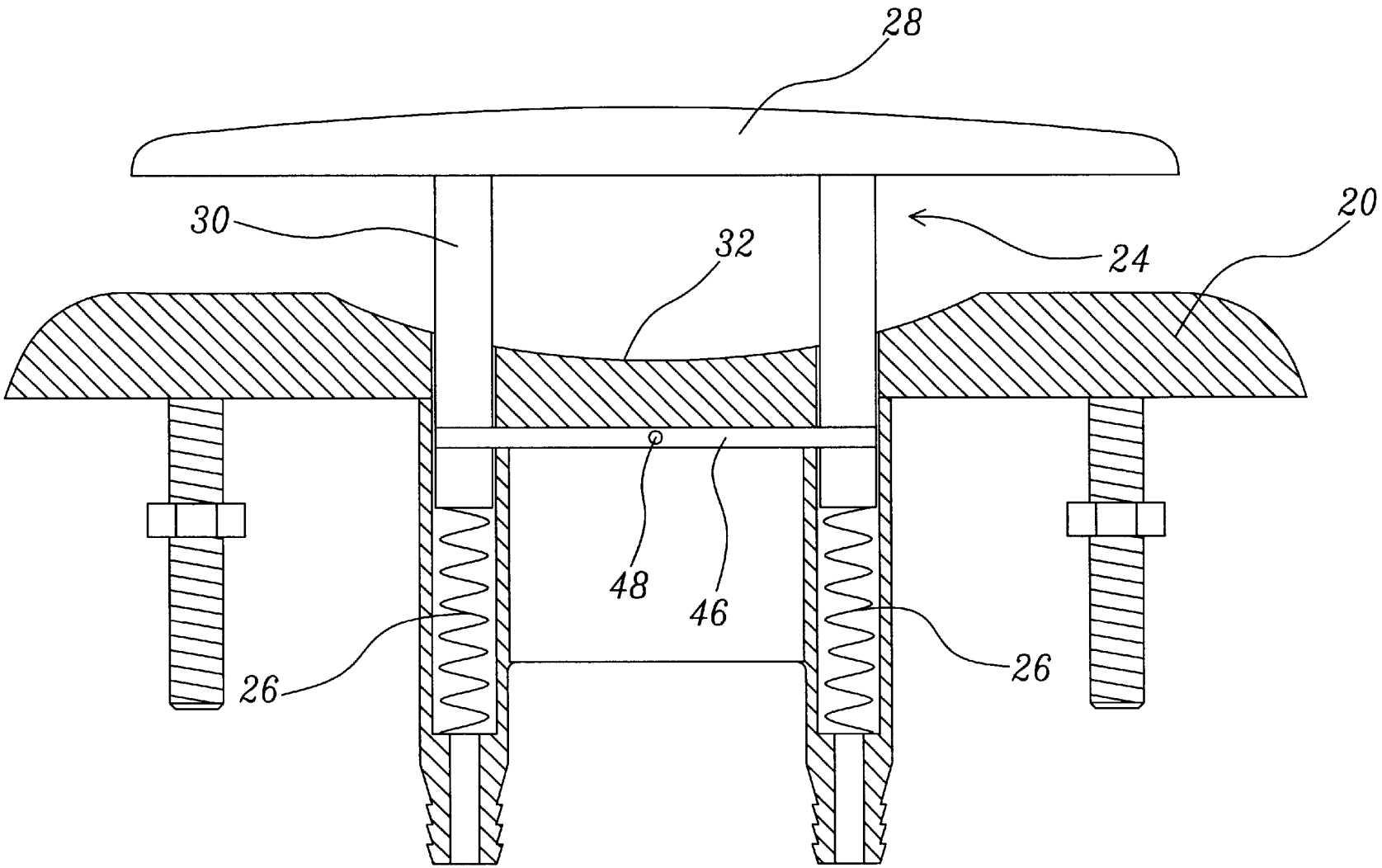
FIG. 4 is a cross-sectional structure diagram of the present invention.

Referring to FIG. 4, the mobile pile 24 comprises a transverse rod 28 and two vertical rods 30 connected below the transverse rod 28. The two vertical rods 30 of the mobile pile 24 engage the springs 26 so as to be disposed in the sliding direction in the vertical holes 22 of the seat body 20. A slidable connection is thus formed between the mobile pile 24 and the seat body 20. A groove 32 is disposed at the top of the seat body in substantial alignment below the transverse rod 28 of the mobile pile 24, so as to receive and hide the transverse rod 28.

Figure 5:
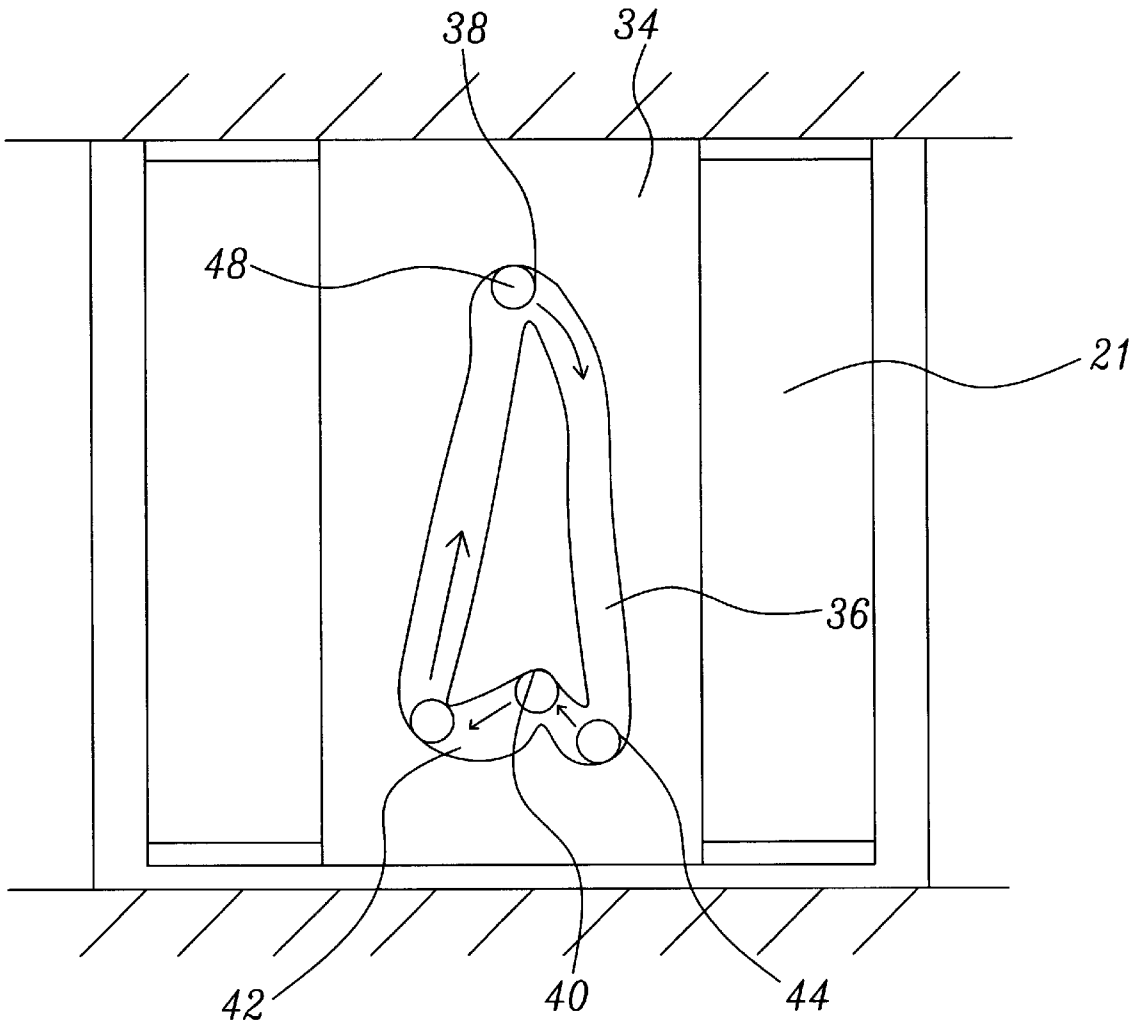
FIG. 5 is a diagram showing a heart-shaped track on a driving piece of the present invention and its principle.

A driving piece 34 capable of moving transversely is disposed in the receiving cavity 21 of the seat body 20. An erect heart-shaped track 36 is disposed on the driving piece 34. Please refer to FIG. 5. The heart-shaped track 36 includes an upper and a lower stop points 38 and 40 and a left and a right transitional points 42 and 44 obliquely placed in the clockwise or counterclockwise direction. The upper stop point 38 is located at the top triangular position of the heart-shaped track 36. The lower stop point 40 is located at the bottom central triangular position of the heart-shaped track 36. The two transitional points 42 and 44 are below the lower stop point 40, and are located at two sides of the lower stop points 40. A unidirectional circulatory closed track is thus formed. A fixing rod 46 is transversely connected between the two vertical rods 30 of the mobile pile 24. A driving rod 48 is vertically connected on the fixing rod 46. One end of the driving rod 48 is fixed on the mobile pile 24, while the other end thereof is located in the heart-shaped track 36 of the driving piece 34. Through design of the heart-shaped track 36 and oblique placement of the stop points 38 and 40 and the transitional points 42 and 44, one end of the driving rod 48 will slide in the heart-shaped track 36 to hide or unfold the mobile pile 24.

Figure 6:
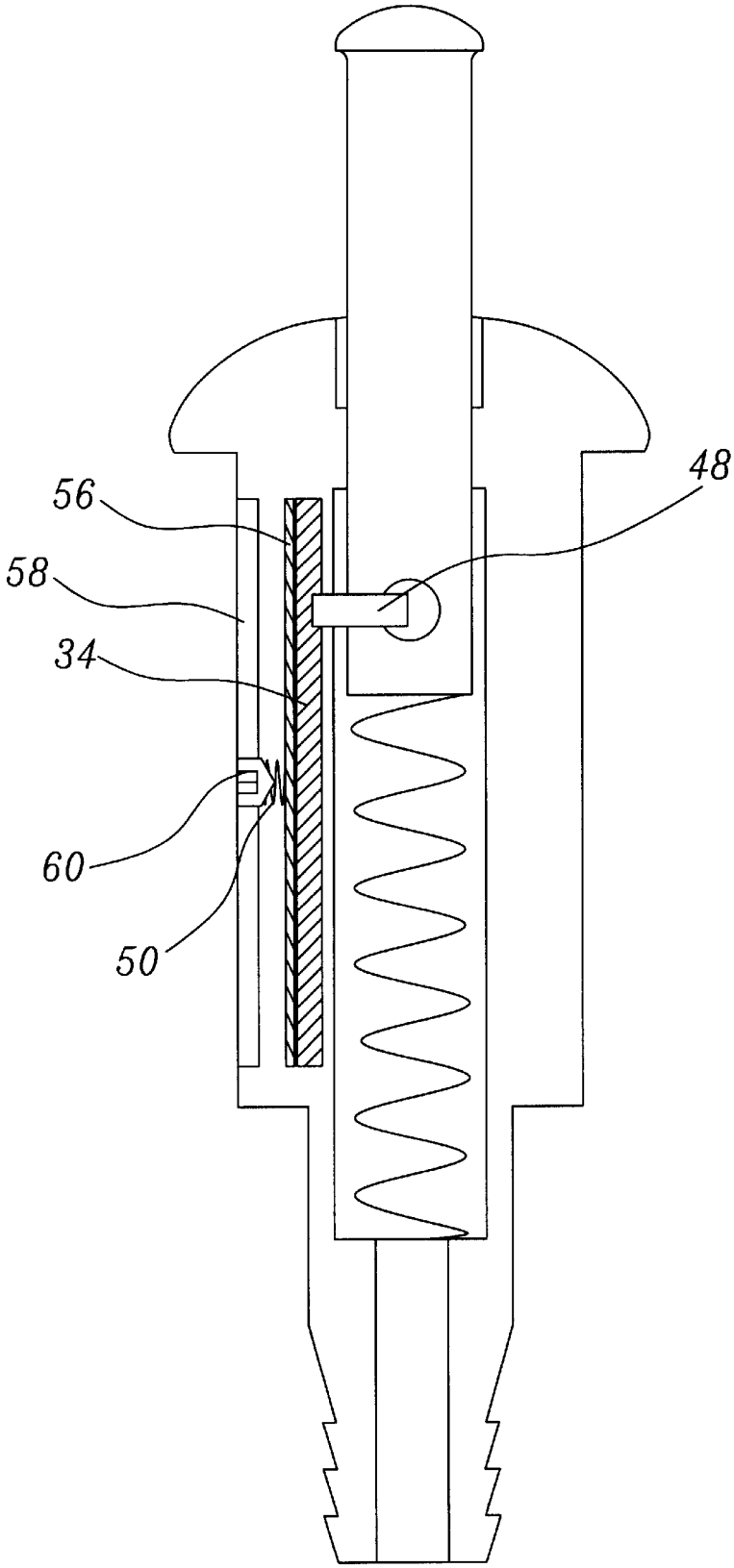
FIG. 6 is a cross-sectional view of a pressing structure of the present invention.

An elastic pressing structure is disposed at the back of the driving piece 34 in the receiving cavity 21. Please simultaneously refer to FIGS. 3 and 6, the pressing structure comprises a pressing board 56 located at the back of the driving piece 34. A fixing board 58 is dispose at the other face of the pressing board 56. At least two adjustment screws 60 pass through the fixing board 58. A spring 50 is slipped onto each of the adjustment screws 60. The spring 50 contacts the pressing board 56 to provide elastic pressure so as to let the pressing board 56 abut against the back of the driving piece 34, hence exactly fixing the driving piece 34 in an effective range. Even when the cleat of the present invention is vertically installed on a boat body, one end of the driving rod 48 can be ensured to make a unidirectional circulatory motion in the heart-shaped track 36 on the driving piece 34, and will not be immovable due to gravity.

In the present invention, the stop points and the transitional points on the driving piece are obliquely placed in the clockwise or counterclockwise direction. Therefore, the driving rod in the heart-shaped track can only slide forwards along the track, and cannot slide reversely. In structure, the center of the driving rod deviates toward one side of the front track. Thereby, the driving rod can be ensured to simultaneously make unidirectional circulatory motion in the heart-shaped track along with upward and downward slide of the mobile pile. When the driving rod slides to the upper stop point, it stops at the top triangular position of the heart-shaped track. When the driving rod slides to the lower stop point, it stops at the central triangular position of the heart-shaped track. The upper and lower stop positions let the mobile pile have a hidden and an unfolded working states.

Figure 7:
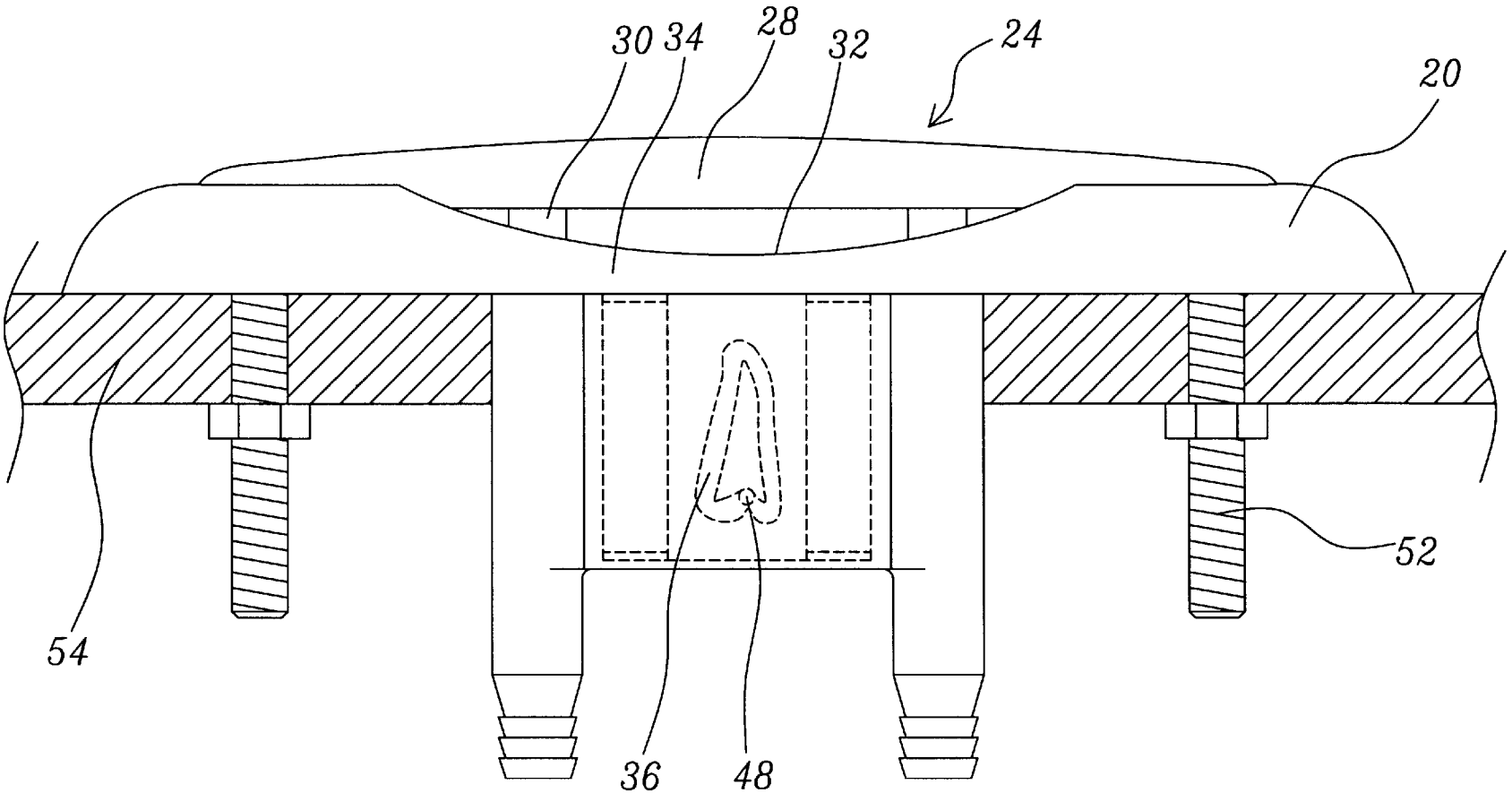
FIG. 7 is a diagram of a hidden cleat of the present invention, which is in the hidden state.
Figure 8:
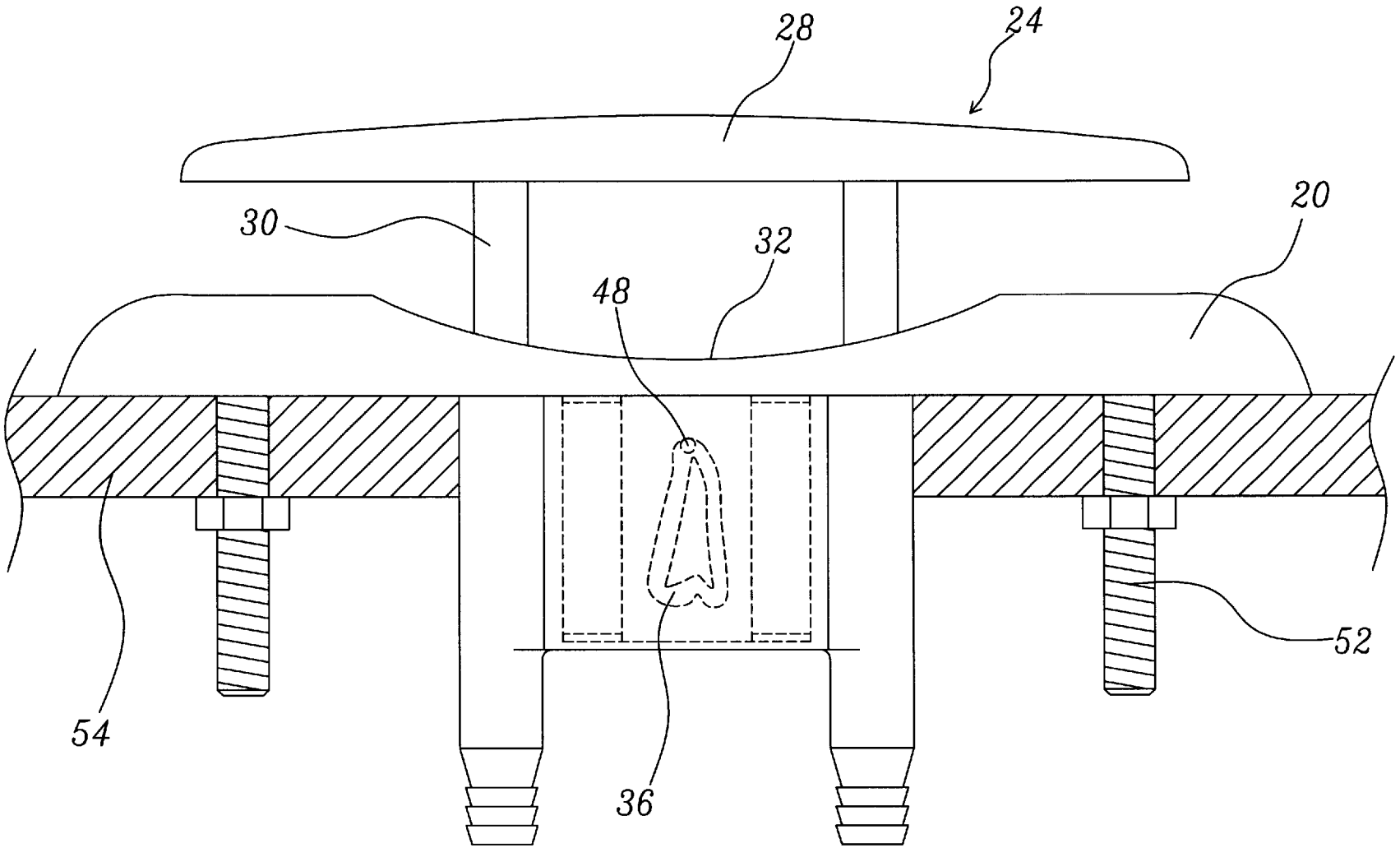
FIG. 8 is a diagram of a hidden cleat of the present invention, which is in the unfolded state.

As shown in FIG. 7, the hidden cleat utilizes several screw bolts 52 to fixedly lock the seat body 20 onto a boat deck 54. When the hidden cleat is in the common hidden state, the driving rod 48 is located at the lower stop point of the heart-shaped track 36. When a cable is to be wound and tied up, it is only necessary to apply a vertical downward external force from exactly above the mobile pile 24. After the mobile pile 24 transfers the external force to the driving rod 48, the driving rod 48 will press downwards in the heart-shaped track to compel the driving piece 34 to slide rightwards, hence letting the driving rid 48 move from the lower stop point 40 to the left transitional point 42. Please simultaneously refer to FIG. 5. When the external force is released, the mobile pile 24 will be vertically pushed upwards by the springs 26, letting the driving rod 48 move to the upper stop point 38. At this time, the mobile pile 24 will protrude out from the seat body 20, as shown in FIG. 8. This is the unfolded state. When a user needs not to tie a cable, he applies a vertical downward external force from exactly above the mobile pile 24. Similarly, the mobile pile 24 will slide downwards. The driving rod 48 will slide downwards along the heart-shaped track 38 to push the driving piece 34 to slide first leftwards and then rightwards when almost reaching the bottom. This will let the driving rod 48 move from the upper stop point 38 along the track to the right transitional point 44. When the external force is released, the driving rod 48 will move to the lower stop point 40 and stop there through action of the springs 26. At this time, the mobile pile 24 will be hidden in the groove 32 of the seat body 20. Thereby, the above reciprocating actions can be continually repeated.

To sum up, the hidden cleat for boat of the present invention can be conveniently unfolded when in use, and can be conveniently hidden when not in use, hence having the advantage of not occupying space of the boat deck. Moreover, the hidden cleat for boat of the present invention can effectively prevent people passing by from stumbling to provide a hidden cleat structure of convenient use and high safety. Furthermore, the hidden cleat for boat of the present invention can be installed at any convenient place because of its mobile hidden structure.

Although the present invention has been described with reference to the preferred embodiments thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A hidden cleat for a boat, comprising:

a seat body having a receiving cavity therein;

a mobile pile coupled in longitudinally displaceable manner to said seat body for sliding up and down relative to said seat body;

at least two elastic components disposed between said mobile pile and seat body;

a driving piece located in said receiving cavity transversely displaceable manner, an erect heart-shaped track being disposed on said driving piece, said heart-shaped track including an upper and a lower stop points and two transitional points obliquely placed in one of a clockwise or counterclockwise directed configuration, said upper stop point being at a top triangular position of said heart-shaped track, said lower stop point being at a bottom central triangular position of said heart-shaped track, said two transitional points being below said lower stop point and located at two sides thereof, a unidirectional circulatory closed track being thus forming; and, a driving rod having one end fixed relative to said mobile pile and an opposed end engaging said heart-shaped track of said driving piece.

2. The hidden cleat for a boat as claimed in claim 1, wherein said mobile pile comprises a transverse rod and two vertical rods extending downward therefrom, said two vertical rods being connected to said elastic components to be disposed in said seat body along the sliding direction.

3. The hidden cleat for a boat as claimed in claim 2, wherein vertical holes corresponding to said two vertical rods are formed in said seat body to receive said elastic components for biasing said two vertical rods along the sliding direction in said seat body.

4. The hidden cleat for a boat as claimed in claim 2, wherein a groove is disposed at a top of said seat body aligned with said transverse rod of said mobile pile to receive and hide said transverse rod.

5. The hidden cleat for a boat as claimed in claim 2, wherein said driving rod is connected to a fixing rod transversely extending between said two vertical rods.

6. The hidden cleat for a boat as claimed in claim 1, wherein a pressing structure is further disposed at a back of said driving piece in said receiving cavity.

7. The hidden cleat for a boat as claimed in claim 6, wherein said pressing structure comprises a pressing board located at the back of said driving piece, a fixing board being disposed adjacent an outer face of said pressing board, at least two adjustment screws being disposed on said fixing board, a spring being slipped onto each of said adjustment screws, each of said springs contacting said pressing board to bias said pressing board against the back of said driving piece.

8. The hidden cleat for a boat as claimed in claim 1 or 4, wherein said elastic components each include a spring.

* * * * *